US007115087B2

(12) United States Patent
Held et al.

(10) Patent No.: US 7,115,087 B2
(45) Date of Patent: Oct. 3, 2006

(54) CUTTING DEVICE

(75) Inventors: Michael Held, Heuchelheim (DE); Sebastian Alois Prüm, Kaiserslautern (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/505,170

(22) PCT Filed: Feb. 28, 2003

(86) PCT No.: PCT/DE03/00675

§ 371 (c)(1),
(2), (4) Date: Aug. 31, 2004

(87) PCT Pub. No.: WO03/074401

PCT Pub. Date: Sep. 12, 2003

(65) Prior Publication Data

US 2005/0103174 A1 May 19, 2005

(30) Foreign Application Priority Data

Mar. 4, 2002 (DE) ..... 102 09 214

(51) Int. Cl.
*B31F 1/10* (2006.01)

(52) U.S. Cl. ..... 493/428; 493/432; 493/431

(58) Field of Classification Search ..... 493/428, 493/429, 432, 431, 434; 270/20.1, 21.1
See application file for complete search history.

(56) References Cited

U.S. PATENT DOCUMENTS 1,798,910 A 3/1931 Smith
2,353,609 A * 7/1944 Zuckerman ..... 270/43
2,872,186 A * 2/1959 Raybuck ..... 493/418
2,891,791 A * 6/1959 Chase ..... 493/432
2,941,798 A 6/1960 Harless
3,521,878 A * 7/1970 Boza-Schunemann ..... 493/429
4,036,487 A * 7/1977 Heimlicher et al. ..... 493/428
4,391,596 A * 7/1983 Fischer ..... 493/425
4,445,881 A 5/1984 Bullen et al.
4,564,183 A 1/1986 Muller
4,634,414 A * 1/1987 Hollmann ..... 493/213
5,049,123 A 9/1991 Breton et al.
5,242,367 A * 9/1993 Marmin ..... 493/359
5,749,567 A * 5/1998 DeAngelis ..... 270/7
6,165,118 A * 12/2000 Eckert ..... 493/425
6,257,142 B1 * 7/2001 Baba ..... 101/480
6,279,890 B1 * 8/2001 Tomczak ..... 270/21.1

FOREIGN PATENT DOCUMENTS

| | | |
|---|---|---|
| AT | 222671 | 8/1962 |
| CH | 278305 | 1/1952 |
| DE | 178565 | 10/1905 |
| DE | 239837 | 4/1910 |

(Continued)

*Primary Examiner*—Sameh H. Tawfik
(74) *Attorney, Agent, or Firm*—Jones, Tullar & Cooper, P.C.

(57) ABSTRACT

A cutting device is used to accomplish the transverse cutting of at least a first material web. The cutting device includes a cutting cylinder and a first counter cylinder. These two cylinders rotate cooperatively and define a first gap through what a first transport path for the first web runs. The cutting cylinder has at least one cutting blade, that cuts a product off the web passing through the gap. The cutting cylinder also has a holding device for holding a cut product and for transporting it through the gap. The counter cylinder comprises a thrust bearing cooperating with the cutting blade.

13 Claims, 4 Drawing Sheets

FOREIGN PATENT DOCUMENTS

| | | |
|---|---|---|
| DE | 2517000 | 4/1975 |
| DE | 2805643 | 2/1978 |
| DE | 1537714 | 1/1979 |
| DE | 3404170 | 2/1984 |
| DE | 3527710 | 8/1985 |
| DE | 9320814.6 | 12/1993 |
| GB | 2014114 | 8/1979 |

* cited by examiner

CUTTING DEVICE

CROSS-REFERENCE TO RELATED APPLICATIONS

This patent application is the U.S. National Phase, under 35 USC 371, of PCT/DE 03/00675, filed Feb. 28, 2003; published as WO 03/074401 A1 on Sep. 12, 2003, and claiming priority to DE 102 09 214 filed Mar. 4, 2002, the disclosures of which are expressly incorporated wherein by reference.

FIELD OF THE INVENTION

The present invention is directed to a cutting device. The cutting device is used for the transverse cutting of a web of material. It includes a cutting and conveying cylinder, and a first counter cylinder.

BACKGROUND OF THE INVENTION

A typical cutting device is employed, for example, for separating paper webs, which have been imprinted on a web-fed rotary printing press, into individual signatures.

DE 26 17 000 C2 and AT 222 671 both show cylinders with cutters and spur devices. The cylinders act together with counter cylinders and form a single cutting gap.

DE 35 27 710 A1 discloses a folding apparatus. Two folding blade cylinders act together with a folding jaw cylinder. Each folding blade cylinder is fed its own web.

DE 239 837 C describes a cutting device for the transverse cutting of webs of material. A cutting and conveying cylinder cooperates with two counter-cylinders and forms respective cutting gaps.

A folding apparatus is known from DE 34 04 170 A1. A cutting and conveying cylinder has a cutting blade and a web of material is looped around it.

SUMMARY OF THE INVENTION

The object of the present invention is directed to providing a cutting device.

In accordance with the present invention, this object is attained by the provision of a cutting device which is usable for the transverse cutting of at least a first web. A cutting and conveying cylinder and a counter cylinder can be rotated together and define a first cutting gap through which a first conveying path of the web of material extends. A second counter-cylinder may be used with the cutting and conveying cylinder and forms a second cutting gap. A second web of material can also be cut. The cutting and conveying cylinder can be a folding blade cylinder or a collection cylinder.

The advantages to be gained by the present invention lie, in particular, in that the re-cutting device removes the danger of cutting already separated signatures again during another passage of these already cut signatures through a cutting gap, without requiring elaborate displacement devices or an uncommonly great precision of the control of the rotations of the individual cylinders of the cutting device. Since the cutting cylinder in the cutting device in accordance with the present invention also takes on the function of a conveying cylinder for separated products, as long as a single signature is held on the cutting and conveying cylinder, it is located between the two cutter blades by which it had been cut. During this time, the cutting blades and the signature do not move with respect to each other, in order to assure that, during another passage through a cutting gap, the signature is not again cut.

A spur strip, in particular, can be used as a holding device on the cutting and conveying cylinder. A counter-cylinder, which is required as a backstop for the cutting blades of the cutting cylinder during cutting, can then advantageously be equipped with at least one recess that is adapted for receiving the spur needles which are supported on the spur strip.

Another advantage of the cutting device in accordance with the present invention lies, in particular, in that it makes possible the joining of two webs of material, which two webs of material are fed to the conveying cylinder on two separate conveying paths, into a common product, or that it permits the processing of a very large number of layers of material by the joining together of two partial webs. In this way, it is possible to form products having a high number of pages, twice as fast as during collection operation and while using a single cutting gap.

BRIEF DESCRIPTION OF THE DRAWING

Preferred embodiments of the present invention are represented in the drawings and will be described in greater detail in what follows.

Shown are in.

DESCRIPTION OF THE PREFERRED EMBODIMENT

Figure 1:
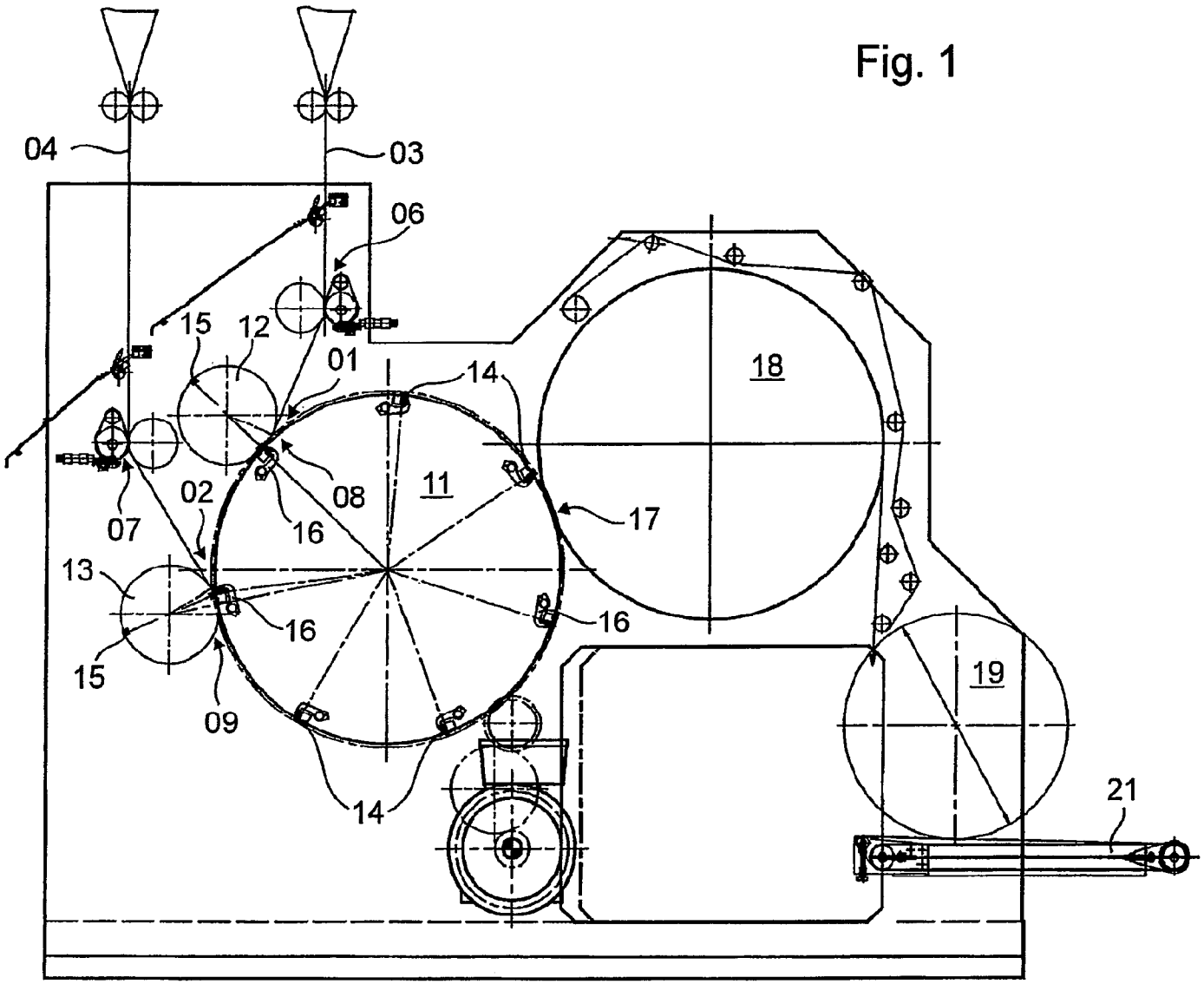
FIG. 1, a schematic side elevation view of a folding apparatus with a cutting device in accordance with the present invention, in FIG. 2, an enlarged depiction of a detail taken from FIG. 1, in FIG. 3, a schematic representation of a first mode of operation, and in FIG. 4, a schematic representation of a second mode of operation.

A schematic side elevation view of a folding apparatus is represented in FIG. 1. This folding apparatus has two web inlets 01, 02 for the receipt of multi-layered webs 03, 04 of material, in particular paper webs 03, 04, which multi-layer webs 03, 04 will be hereinafter identified as the inner web 03 or as the outer web 04 in what follows. Both webs 03, 04 pass through a respective traction roller pair 06, 07, respectively for setting their tension and both webs then encounter a cutting and conveying cylinder 11 at the height of respective cutting gaps 08, 09. These gaps 08, 09 are formed between the cutting and conveying cylinder 11, on the one hand, and one of two counter-cylinders 12, 13 on the other hand. In place of two inlets 01, 02 and two cutting gaps 08, 09, it is also possible to provide three or more inlets and cutting gaps. In the course of this web travel, the webs 03, 04 preferably first come into contact with the respective counter-cylinder 12, 13 in each cutting gap 08, 09, respectively, and thereafter come into contact with the cutting and conveying cylinder 11. The webs thus first loop around the counter cylinder 12, 13 and then around the cutting and conveying cylinder 11.

The circumference of the cutting and conveying cylinder 11 corresponds to more than five, and preferably to seven lengths of the signature to be formed. This cylinder circumference supports more than five, and preferably supports seven cutting blades that are evenly distributed over its circumference, which cutting blades are shown at 14 in FIGS. 1 and 2, and a holding device 16, for example a spur strip 16, which is located closely behind each cutting blade 14 in its movement direction, which movement direction is a rotation in a counterclockwise direction, as shown in FIG. 1. Such a spur strip 16, which can be pivoted around a shaft 22 and which supports spur needles 23, is shown enlarged in FIG. 2 at the moment of its passage through the first cutting gap 08 at the point of cooperation with the first counter-cylinder 12.

Each one of the identically constructed first and second counter-cylinders 12 or 13 has a circumference with a circumference length corresponding to at least one, and preferably to two lengths of the signatures to be produced from the webs 03, 04. Each counter-cylinder supports at least one, and preferably supports two counter-cutting strips 15 which are cut or inlaid into its circumferential surface. These strips may be, for example, hard rubber strips, which are used as backstops 15 for the cutting blades 14 when these cutting blades 14 are cutting the webs 03 or 04. A groove 24 is located directly behind, or after, each backstop 15 in the movement direction of the counter-cylinder 12 or 13 with each groove 24 being adapted for receiving the tips of the spur needles 23 of the spur strip 16 which tips of the spur needles 23 are, during their passage through the cutting gap 08 or 09, extended over the circumference of the cutting and conveying cylinder 11.

In the position of the cutting device represented in FIG. 1, a cutting blade 14 of the cutting and conveying cylinder 11 and a backstop 15 of the counter-cylinder 12 are just passing through the cutting gap 08 and, in the process, cooperate to cut the inner web 03. The leading edge of the inner web 03, which is formed by this cut, is spiked on the spur needles 23 of a spur strip 16, which spur strip 16 had been extended briefly prior to reaching the cutting gap 08 and which also fixedly hold the inner web leading edge on the surface of the cutting and conveying cylinder 11 during further conveying.

The signature cut off the inner web 03 in this process is conveyed on by the cutting and conveying cylinder 11 to the second cutting gap 09, where the outer web 04 is placed on top of it, is also spiked by the spur needles 23 of the spur strip 16 and is cut by the same cutting blade 14. Since, between the passage of the signature cut from web 03 through the first cutting gap 08 and the passage through the second cutting gap 09, the cutting blades 14 and the spur strips 16 did not move in relation to the cutting and conveying cylinder 11, there is no danger that the signatures cut from the web 03 in the first cutting gap 08 are again cut during the passage through the second cutting gap 09.

Figure 2:
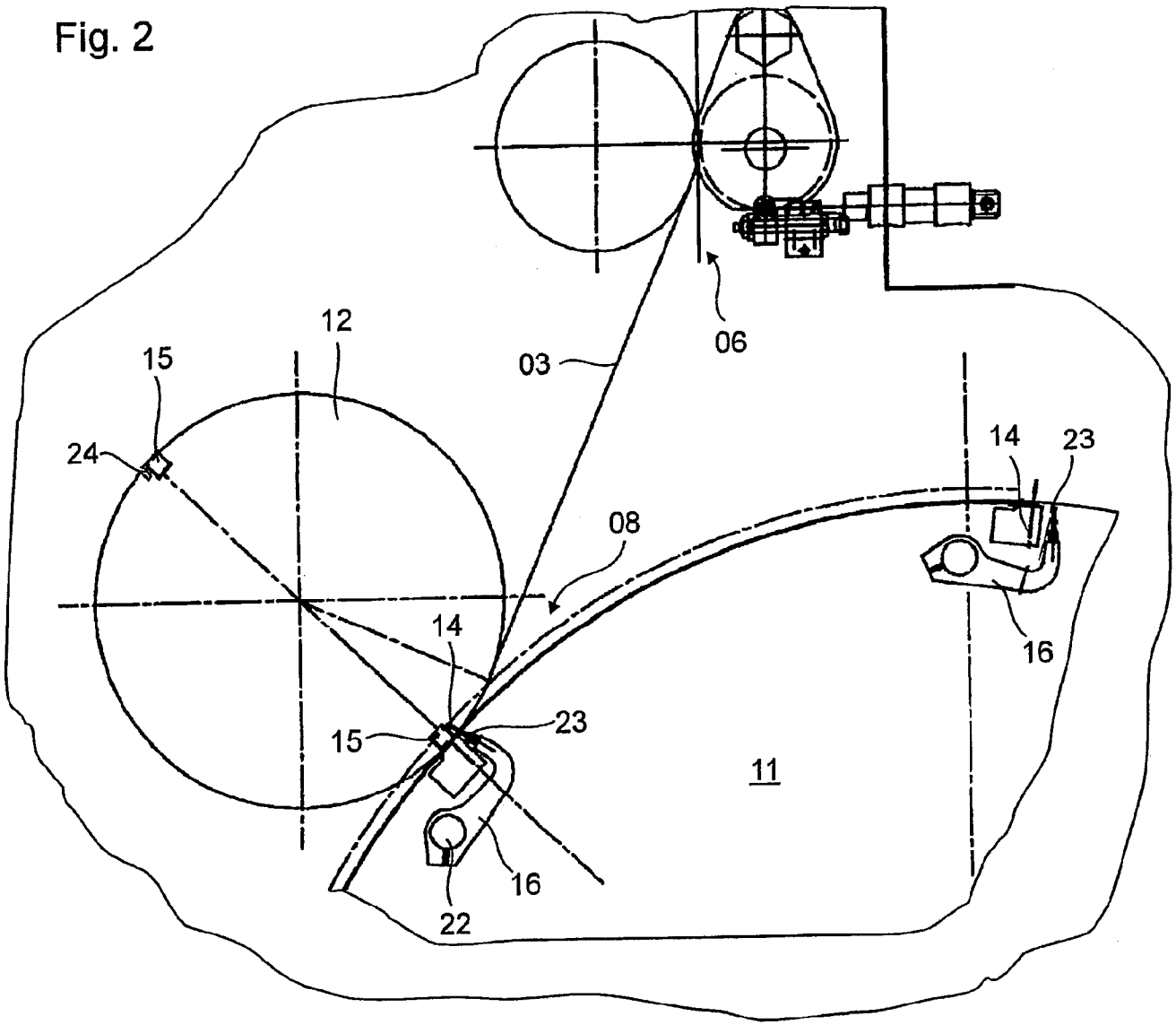

At the locations of the first and second cutting gaps 08 and 09, the tips of the spur needles 23, as may be seen in FIG. 2, extend farther past the circumference of the cutting and conveying cylinder 11 than the cutting blades 14, in order to assure that the spur needle tips have already been pushed through the web 03 or 04 before either of the webs 03 or 04 are cut by the cutting blade 14.

In the example represented in FIGS. 1 and 2, the angular distance between the two cutting gaps 08, 09 is approximately 50°. This cutting gap angular distance can differ from the angular distance of the spur strips 16 from each other, which is typically 51.5° or a multiple thereof, so that cutting is not performed simultaneously at both cutting gaps 08, 09. A half-integral multiple of this value is also disadvantageous from the viewpoint of vibration avoidance.

Following its passage through the second cutting gap 09, each spur strip 16 supports a whole product, which is composed of signatures cut off the inner web 03 and of signatures cut off the outer web 04, respectively. Seven whole signatures or products are formed in the course of every revolution of the cutting and conveying cylinder 11 in the same way as if both webs 03, 04 were fed via a common inlet in the customary way. However, since the cutting of each individual signature is spaced over two separate cutting steps at the first and second gaps 08, 09, the force required to be provided in each cutting step is less. The result is that a satisfactory synchronous running of the machine is easier to maintain and the demands made on the mechanical stress capability of the cutting device are also less than in case of feeding both webs 03, 04 through one common inlet.

Furthermore, at least five, and preferable seven folding blades, which are not specifically represented, are attached to the cutting and conveying cylinder 11, each of which folding blades is extended when reaching a gap 17 between the cutting and conveying cylinder 11 and a folding jaw cylinder 18 in order to transfer the products conveyed by the cutting and conveying cylinder 11 to the folding jaw cylinder 18 in a manner that is known per se, and to thereby fold them. The folded products are then transferred from the folding jaw cylinder 18 to a bucket wheel 19 and are deposited by the bucket wheel on a conveyor belt 21.

A modified or second preferred embodiment of a cutting device in accordance with the present invention differs from the one represented in FIG. 1 in that the second embodiment has only a single inlet 02 for a single web 04 to be cut. For its description, reference is again made to FIG. 1, wherein the first inlet 01, the inner web 03 and the first counter-cylinder 12 are now assumed not to exist.

Figure 3:
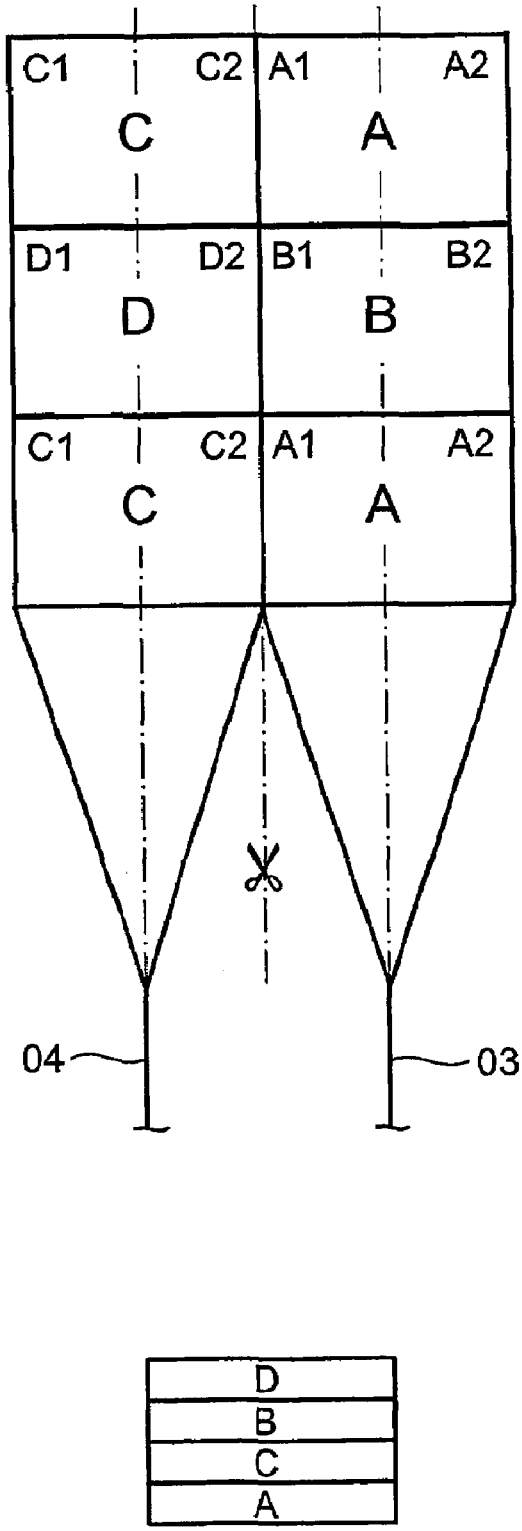

The web 04, fed in at the inlet 02 and having alternating patterns C and D, for example an imprinted web 04, as seen at the left in FIG. 3, meets the cutting and conveying cylinder 11 at the cutting gap 09, whose spur strips 18, when entering the cutting gap 09, alternatingly carry a previously cut off signature with the pattern C, which signatures was previously cut off the web 04, or no signature. Since the number of spur strips 16 is odd, at the cutting gap 09, an empty spur strip 16 respectively meets a pattern C of the web 04, and a spur strip 16 already equipped with a signature, with pattern C, meets a signature with the pattern D of the web 04. Since the cutting blades 16 are rigidly fastened on the cutting and conveying cylinder 11, and because the spur strips 16 do not move in relation to the cutting and conveying cylinder 11 between their first passage through the cutting gap 09, where they are loaded with the signature with the pattern C, and their second passage, where they receive D signatures, there is no danger that the signatures with the pattern C are again cut during the second passage through the cutting gap 09.

Every time a spur strip 16, now equipped with the two sequentially collected signatures C and D, passes through the gap 17, the total product obtained in this way is transferred, in a manner which is known per se, to the folding jaw cylinder 18.

In all of the modes of operation, a further conveying cylinder, usable for taking over the signatures, can be connected downstream of the cutting and conveying cylinder 11, instead of the folding jaw cylinder 18. A folding jaw cylinder or a belt system can be arranged downstream of this further conveying cylinder.

It is also possible for each of the webs 03, 04 to have the same patterns A or B located one behind the other, i.e. in the conveying direction, as depicted at the right in FIG. 3. Preferably these patterns A and B are imprinted by the use of at least one forme cylinder of a printing unit, which at least one forme cylinder has two identical patterns A and B on its circumference. The webs 03, 04 are guided on top of each other, so that signatures with patterns A and B located on top of each other are formed, each of which web is transferred to the downstream located folding jaw cylinder 18 in the gap 17. The cutting and conveying cylinder 11 does not absolutely have to have an odd-numbered division, but instead can also have an even-numbered division, preferably greater than 4 or 6.

Preferably, each of the patterns A, B, C, D identifies two newspaper pages, wherein A1, A2, B1, B2, C1, C2, D1, D2 each identifies a newspaper page.

The identification 03, 04 is understood to represent at least one web 03, 04, but preferably should be understood to be a representation of a strand consisting of several webs 03, 04 placed on top of each other.

Here, the webs 03, 04 can each be imprinted by the use of forme cylinders of printing units, which either have a pattern A or a pattern B on the circumference, which is a single circumference, or two patterns A or B on the circumference, which is a double circumference. With double circumference forme cylinders, two identical patterns A, A, or B, B, or two different patterns A, B can be arranged on the circumference.

Therefore, four modes of operation of the present invention are possible.

In a first and a second mode of operation, both webs 03, 04 are brought together on the cutting and conveying cylinder 11 ahead of the first inlet 01, or the second inlet 02 and are severed in the course of a single cutting operation.

In this case, in a first mode of operation the webs 03, 04 have identical patterns A or C in sequence, and the sane products are formed sequentially on the cutting and conveying cylinder 11 during each revolution and are directly transferred to the downstream located folding jaw cylinder 18.

In the second mode of operation, the webs 03, 04 have patterns A, B or C, D, which alternate behind each other and which are alternatingly deposited on the cutting and conveying cylinder 1 during a first revolution of the cutting and conveying cylinder 11, which is provided with an odd number of fields, and is thus a collection cylinder, and are additionally provided with a second layer of the folding product portion during the second revolution.

In a third and fourth mode of operation, two webs 03, 04 are separately fed in, wherein in the third mode of operation the webs 03, 04 alternatingly bear the patterns A, B or C, D located one behind the other, as may be seen in FIG. 3.

In this third mode, during a first revolution of the cutting and conveying cylinder 11, acted as a collection cylinder, first signatures with the pattern A, C of each web 03, 04 are conducted on all and every second spur strip 16, so that now every second spur strip 16 carries a signature with the pattern A, C, and during the second revolution again two signatures with the pattern B, D from each web 03, 04 are conducted on the spur strips 16.

Therefore, during the second revolution of the cutting and conveying cylinder 11, signatures A, C, B, D on the spur strips 16 alternate with spur strips 16 carrying only signatures with the patterns A, C, wherein the signatures, i.e. the product with the pattern A, B, C, D of each second field, are transferred to the folding jaw cylinder 18.

Figure 4:
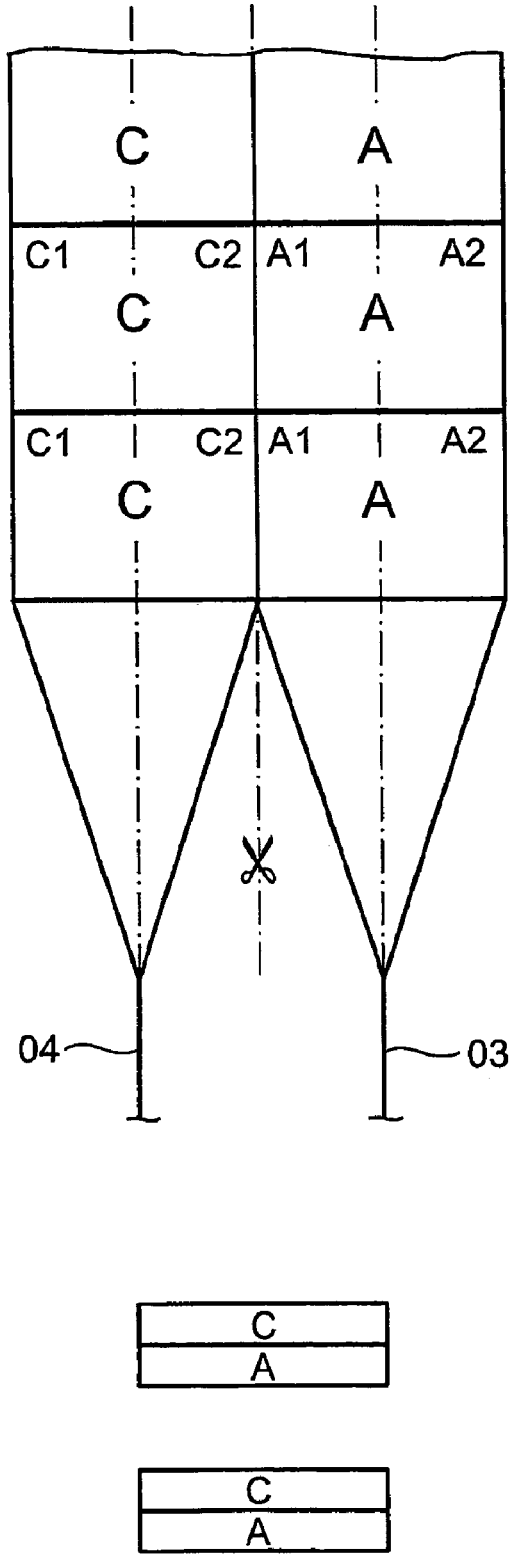

In a fourth mode of operation, the webs 03, 04 each have identical patterns A, A, or C, C located behind each other, as seen in FIG. 4, so that, with each revolution of the cutting and conveying cylinder 11, each spur strip 16 carries signatures with the pattern A, C, which are directly transferred to the folding jaw cylinder 18 when they arrive there.

While preferred embodiments of a cutting device, in accordance witht the present invention, have been set forth fully and completely hereinabove, it will be apparent to one of skill in the art that various changes in, for example, the types of webs being printed on, the specific structure of the printing devices, and the like could be made without departing from the true spirit and scope of the subject invention which is accordingly to be limited only by the following claims.

What is claimed is:

1. A cutting device adapted to transversely cut at least a first web of material comprising:

a cutting and conveying cylinder;

a first counter-cylinder cooperating with said cutting and conveying cylinder and defining a first cutting gap through which a first web conveying path extends;

at least a first cutting blade on said cutting and conveying cylinder and being usable for cutting off a first product from a first web of material in the course of passage of said at least first cutting blade through said first cutting gap;

a first backstop on said first counter-cylinder and cooperating with said at least first cutting blade in said first cutting gap;

a holding device on said cutting and conveying cylinder adapted to hold the first cut-off product and to convey the first product through said first cutting gap; and a second counter-cylinder cooperating with said cutting and conveying cylinder and defining a second cutting gap through which a second web conveying path extends, said at least first cutting blade being usable for cutting off a second product from a second web of material in the course of passage of said at least first cutting blade through said second cuffing gap.

2. The cutting device of claim 1 wherein said first conveying path extends around said first counter-cylinder at an inlet to said first cutting gap.

3. The cutting device of claim 1 wherein said holding device is a spur strip.

4. The cutting device of claim 3 including spur needles on said spur strip and further including at least one spur needle receiving groove on said first counter-cylinder.

5. The cutting device of claim 1 wherein said cutting and conveying cylinder has a circumference having a length equal to at least five product lengths.

6. The cutting device of claim 1 further including a first web inlet to said first cutting gap.

7. The cutting device of claim 6 further including a second web inlet to said second cutting gap.

8. The cutting device of claim 1 further including a folding jaw cylinder arranged directly after said cutting and conveying cylinder.

9. The cutting device of claim 8 wherein said cutting and conveying cylinder is a folding blade cylinder.

10. The cutting device of claim 1 further including means for feeding said second web to said cutting and conveying cylinder for engagement with said first web of material after, in a direction of rotation of said cutting and conveying cylinder, said first web conveying path.

11. The cutting device of claim 10 further including a second backstop on said second counter-cylinder and cooperating with said at least first cutting blade to cut said second product of said second web during said passage of said at least first cutting blade through said second cutting gap.

12. The cutting device of claim 11 wherein said first web of material loops around said first-counter cylinder and then around said cutting and conveying cylinder and further wherein said second web of material loops around said second counter-cylinder and then around said cutting and conveying cylinder.

13. The cutting device of claim 1 further including a second backstop on said second counter-cylinder and cooperating with said at least first cutting blade in said second cutting gap.

* * * * *